United States Patent [19]

Katsiaficas

[11] 4,189,149

[45] Feb. 19, 1980

[54] RECREATIONAL STRUCTURE INCLUDING FLEXIBLE TUBULAR MEMBER

[76] Inventor: Mary D. Katsiaficas, 2111 8th Ave. N., Seattle, Wash. 98109

[21] Appl. No.: 831,535

[22] Filed: Sep. 8, 1977

[51] Int. Cl.[2] ..... A63B 9/00

[52] U.S. Cl. ..... 272/113

[58] Field of Search ..... 272/113, 112, 93, 144, 272/109; 9/2 A, 11 A, 11 R, 12, 13; 46/23, 87, 88, 151; 5/343, 340; 248/49, 251; 135/5 R, 1 C, 1 R; 52/2

[56] References Cited

U.S. PATENT DOCUMENTS

| | | | |
|---|---|---|---|
| 243,869 | 7/1881 | Doremus | 5/340 |
| 263,987 | 9/1882 | Steele | 135/1 R X |
| 715,603 | 12/1902 | Quarrie et al. | 135/5 R |
| 2,651,314 | 9/1953 | Hasselquist | 52/2 |
| 3,086,753 | 4/1963 | Cushman | 52/2 X |
| 3,299,451 | 1/1967 | Trogdon | 5/340 X |
| 3,399,408 | 9/1968 | Bailey et al. | 46/88 X |
| 3,601,923 | 8/1971 | Rosenberg | 46/151 |
| 3,628,790 | 12/1971 | Gordon | 272/113 X |
| 3,895,796 | 7/1975 | Pestalozzi | 272/113 |
| 4,027,437 | 6/1977 | Monsky et al. | 52/2 |

*Primary Examiner*—Richard C. Pinkham
*Assistant Examiner*—William R. Browne

[57] ABSTRACT

A recreational structure is disclosed which includes one or more comparatively thick, soft, flexible tubular members supported by a support structure. The support structure may be a pair of rigid spaced apart inclined ramps or a pair of spaced apart sawhorse structures. The ramps or the sawhorses have structure thereon to prevent lateral movement of the tubular members.

3 Claims, 5 Drawing Figures

RECREATIONAL STRUCTURE INCLUDING FLEXIBLE TUBULAR MEMBER

FIELD OF THE INVENTION

This invention relates to large recreational structures for use in playgrounds, schools and the like.

BACKGROUND OF THE INVENTION

A number of recreational structures on which children can climb, swing and otherwise play have heretofore been proposed. Such structures include the well known "jungle jim" structure and are almost always constructed of hard materials such as metal bars or wood in a variety of shapes and configurations.

SUMMARY OF THE INVENTION

This invention provides a recreational structure comprising one or more thick, soft and flexible tubular members supported by support means. The tubular members are at least a foot in diameter when uncompressed. Such recreational structures provide novel and safe toys on which children can climb and play. In some embodiments, the support means comprises a pair of ramps or sawhorse structures and the tubular members are positioned over and between such ramps or sawhorses.

These and other features of this invention will become apparent in the detailed description and claims to follow taken in conjunction with the accompanying drawings.

DETAILED DESCRIPTION OF THE DRAWINGS

Figure 1:
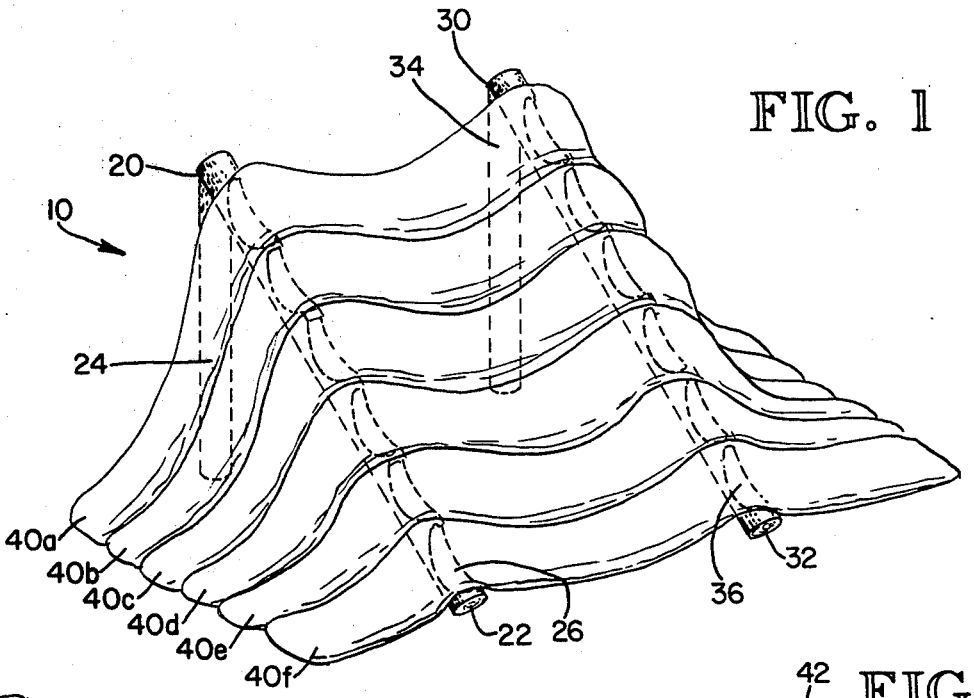
FIG. 1 is a perspective view of one embodiment of the recreational structure of the present invention.
Figure 2:
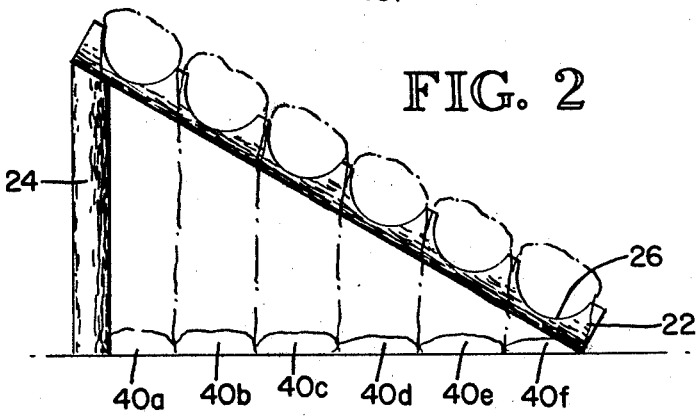
FIG. 2 is a cross-sectional view taken along the line 2—2 of FIG. 1.
Figure 3:
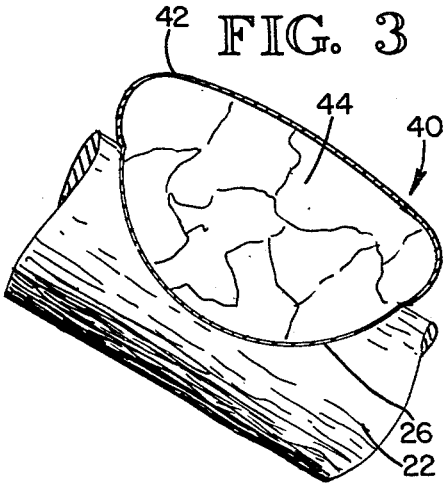
FIG. 3 is an expanded view of a portion of the cross section of FIG. 2.

FIGS. 1–3 illustrate a recreational structure, generally referred to at 10, according to one embodiment of the present invention. The recreational structure has support means comprising ramps 20, 30 which support a plurality of tubular members 40*a–f*. Each ramp 20, 30 respectively comprises an inclined member 22, 32 and a vertical post member 24, 34. Preferably the scale is such that the ramps are 4–8 feet off the ground at their highest points. The ramps of the embodiment shown in FIG. 1 are constructed of peeled core logs, which may be vinyl coated. Other materials, such as vinyl coated aluminum, could also be used for the ramps. Because recreational structure 10 is intended primarily for use by children, the ramps are preferably constructed such that they contain no sharp points or edges which might cause injury.

Each of the inclined members 22, 32 contains a series of recesses, such as those at 26, 36, corresponding in number to the number of tubular members 40. The recesses receive the tubular members and serve to prevent them from sliding down the inclined members 22, 32 or otherwise shifting in position. Other means may also be used to secure the tubular members to the ramps. Such means may for example comprise wickets or other upwardly extending structures which may also serve as gripping or climbing means for persons playing on the recreational structure.

One of the tubular members 40 is shown in cross section in FIG. 3. The tubular member comprises a flexible outer shell 42 enclosing filler material 44. Preferably, the filler material is soft and somewhat compressible, and scrap cloth or clothing enclosing a more lightweight filler material such as dacron polyester has been found ideal. Shell 42 is constructed of a tough yet flexible material such as 12–18 mil soft hand vinyl tubing. If clear vinyl is used, then the colors of the filler material may be selected so as to enhance the attractiveness of the overall recreational structure. The vinyl tubing may be closed around the filler material by stitching, heat sealing, or other conventional means.

Each tubular member is draped over the ramps, as shown in FIG. 1, such that it overlies both ramps at corresponding recesses, and also extends outwardly from the ramps for a considerable distance. The outwardly extending portions of the tubular members 40 assist in securing such members to the ramps without securing means other than recesses 26, 36. If more positive securing means are employed, then such outwardly extending portions of the tubular members may be eliminated, if desired.

The thickness of the tubular members 40 is an important consideration for the recreational structures of the present invention. The tubular members must be of sufficient thickness to provide a support or a seat for a child playing thereon, and thus tubular members at least one foot in diameter are preferred. By the same token, shell 42 must contain enough filler material 44 such that the tubular member will not compress into too small a diameter when a person is sitting or standing thereon. Recreational structures of the type described herein having such tubular members have been found to possess superior qualities as play objects, especially for young children.

Figure 4:
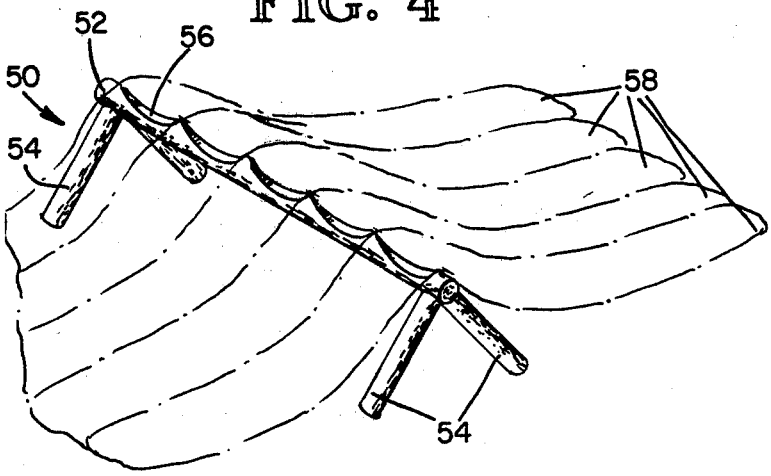
FIG. 4 is a perspective view of a second embodiment of the recreational structure of the present invention.

FIG. 4 illustrates a second embodiment of the present invention, in which a unitary support means 50 is employed. Support means 50 comprises a sawhorse structure having cross member 52 and legs 54. Cross member 52 has recesses, such as at 56, on the upper surface thereof corresponding in number to the number of tubular members 58. Such recesses serve to prevent the tubular members from shifting laterally along cross member 52. Tubular members 58 are identical in size and construction to tubular members 40 of the FIG. 1 embodiment, and are draped over the support means 50 as illustrated in FIG. 4.

Figure 5:
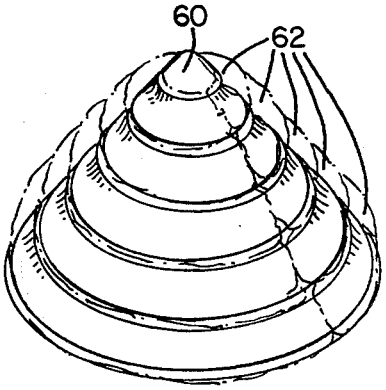
FIG. 5 is a perspective view of a third embodiment of the recreational structure according to the present invention.

FIG. 5 shows yet a third embodiment of the recreational structure of the present invention. In this embodiment, the support structure 60 has a conical shape, and each tubular member 62, similar in size and construction to tubular members 40 and 58 of FIGS. 1 and 4 respectively, has its ends joined together to form a closed loop. Such tubular loop members of decreasing length are then placed over support structure 60 to form the recreational structure shown in FIG. 5.

While the preferred embodiments of this invention have been illustrated and described herein, it should be understood that variations will become apparent to one skilled in the art. Accordingly, the invention is not to be limited to the specific embodiments illustrated and described herein, and the true scope and spirit of the invention are to be determined by reference to the appended claims.

What is claimed is:

1. Recreational structure comprising: a pair of spaced apart structures, a plurality of flexible elongated tubular members completely filled with a compressible solid material, each of said members including a suspended portion supported by said structures and extending between said structures in a free hanging condition, the suspended portions of said members being positioned such that they are approximately parallel to one another, said structures being rigid, and said structures including means mounted thereon for engaging the tubular members so as to prevent movement of said members along said structures.

2. The recreational structure of claim 1, wherein the spaced apart structures include a pair of spaced-apart ramps, wherein each tubular member is supported by both ramps, and wherein each ramp includes said means mounted thereon for engaging the tubular members so as to prevent movement of said members along said ramp.

3. The recreational structure of claim 1, wherein the spaced apart structures comprise a pair of spaced-apart sawhorse structures, wherein each tubular member is supported by both sawhorse structures.

* * * * *